US007980924B2

(12) United States Patent
Blatz

(10) Patent No.: US 7,980,924 B2
(45) Date of Patent: Jul. 19, 2011

(54) COVER DEVICE FOR A POWER TOOL

(75) Inventor: Thomas Blatz, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 450 days.

(21) Appl. No.: 12/220,812

(22) Filed: Jul. 28, 2008

(65) Prior Publication Data

US 2009/0036043 A1 Feb. 5, 2009

(30) Foreign Application Priority Data

Jul. 30, 2007 (DE) ..... 10 2007 000 415

(51) Int. Cl.
*B24B 55/04* (2006.01)
*B24B 55/06* (2006.01)

(52) U.S. Cl. ..... 451/456; 83/544; 83/546; 144/251.1; 451/451; 451/452; 451/455

(58) Field of Classification Search ..... 83/440.2, 83/478, 544, 546; 144/251.1, 251.3, 252.1; 451/344, 354, 356, 357, 358, 359, 451, 453, 451/454, 455, 456, 457, 452
See application file for complete search history.

(56) References Cited

U.S. PATENT DOCUMENTS

| | | | | |
|---|---|---|---|---|
| 2,741,282 | A * | 4/1956 | Wieting | 144/136.1 |
| 3,701,369 | A * | 10/1972 | Gronke et al. | 30/371 |
| 4,693,008 | A * | 9/1987 | Velie | 30/390 |
| 5,974,674 | A * | 11/1999 | Kelly | 30/391 |
| 6,375,557 | B1 * | 4/2002 | Spangenberg et al. | 451/344 |
| 6,935,939 | B1 * | 8/2005 | Buser et al. | 451/451 |
| 6,994,007 | B2 * | 2/2006 | Kenyon et al. | 83/468.7 |
| 7,223,163 | B2 * | 5/2007 | Neumeier et al. | 451/451 |
| 7,300,339 | B2 * | 11/2007 | Gaul et al. | 451/451 |

* cited by examiner

*Primary Examiner* — Timothy V Eley
(74) *Attorney, Agent, or Firm* — Abelman, Frayne & Schwab

(57) ABSTRACT

A cover device for a power tool with at least one disc-shaped working tool (6), includes first and second cover parts (12, 22) and a locking mechanism (41) for releasably pivotally positioning the second cover part (22) relative to the first cover part (12) and having a locking element (46) provided on one of the first and second cover parts (12, 22) and engageable with a counter-locking element (23) provided on another of the first and second cover parts (12, 22), and an actuation member (42) pivotally supported at a pivot point (45) on the one of the first and second cover parts (12, 22) and having an actuation section (43) and a locking section (44) extending at an angle from the actuation section (43), with the locking element (46) being provided at a free end of the locking section (44).

9 Claims, 2 Drawing Sheets

COVER DEVICE FOR A POWER TOOL

BACKGROUND OF THE INVENTION

1. Field of the Invention

The present invention relates to a cover device for a power tool with at least one disc-shaped working tool and including a first cover part for encompassing the disc-shaped working tool of the power tool at least in some regions, a second cover part, supported at a pivot point for pivotal movement relative to the first cover part and a locking mechanism for releasably positioning the second cover part relative to the first cover part and having locking means provided on one of the first and second cover parts and counter-locking means provided on another of the first and second cover parts and engageable with the locking means.

2. Description of the Prior Art

Power tools such as, e.g., cutting and slitting tools having at least one disc-shaped, rotationally driven working tool, are generally provided with a cover device to protect the user and the environment from dust and flying particles.

An above-discussed cover device for a power tool with at least one disc-shaped working tool is disclosed in a European publication EP 1 777 047 A1. The second cover part pivots relative to the first cover part about a roller axle that forms a pivot point, with the disc-shaped working tool being encompassed in some region by the first cover part and the second cover part that overlaps the first cover part. On the second cover part, there is provided an adjustable depth stop that includes locking means engageable with a counter-locking means provided on the second cover part for adjusting the maximum penetration of the working tool. There is further provided a locking mechanism for releasably positioning the second cover part relative to the first cover part.

The locking mechanism includes two locking hooks provided on the second cover part and a shaped plate provided on the first cover part.

The known, preliminary assembled cover device is secure on the power tool. After adjusting a desired cutting depth with the depth stop, the second cover part is pivoted relative to the first cover part up to a stop of a stop rim of the depth stop on a free end of the first cover part. When the power tool is placed on a constructional component, the free end of the second cover part lies on constructional component, so that the second cover part, upon penetration of the disc-shaped working tool in the constructional component, pivots relative to the first cover part against a biasing force as a result of pressure applied to the cover device. In this position of the second cover part relative to the first cover part, the locking hooks of the locking mechanism engage from behind the shaped plate that is provided on the first cover part. In order to release the locking engagement, the engagement of the locking hooks with the shaped plate is lifted off by application of pressure to the depth stop in a direction of the pivot point of the second cover part. The known cover device is easy to operate, and it proved itself in practice.

An object of the invention is to provide a cover device for a power tool with at least one disc-shaped working tool having an even further simplified construction.

Another object of the invention is to provide a cover device having a high stability with respect to the set cutting depth when used for power tools having an increase power.

SUMMARY OF THE INVENTION

These and other objects of the present invention, which will become apparent hereinafter, are achieve by providing a cover device having a locking mechanism that includes, in addition to locking means and counter-locking means, an actuation member pivotally supported at a pivot point on the one of the first and second cover parts and having an actuation section and a locking section extending at an angle from the actuation section, with the locking means being provided at a free end of the locking section.

For positioning the second cover part relative to the first cover part, the locking mechanism holds the two cover parts in their desired relative position already at the start of an operation of the power tool. The section of the disc-shaped working tool that projects out of the cover device determines the maximal penetration depth. The pivotable actuation element insures a stable connection of the two cover parts with each other, which insures obtaining of a constant set cutting depth in the constructional component, with the locking mechanism having a simplified construction.

By pressing the actuation section in the direction of the pivot point of the second cover part, the actuation member would pivot about its pivot point, whereby the locking section with the locking means becomes disengaged from the counter-locking means, and the second cover part is displaced relative to the first cover part and can now be secured to the first cover part anew in another desired position.

Because the functions of force transmission and the biasing action are separated in the inventive locking mechanism, the necessary actuation force for adjusting the cutting force can be selected in accordance the ergonomical requirements, independent from a load applied to the cover device. The actuation member advantageously is formed as a one-piece part, e.g., as a plastic injection-molded part.

The cover parts advantageously each has a radial section and two, spaced from each other, side sections, forming together a receiving space for the disc-shaped working tool and which surrounds the working tool in some regions. In one of the cover part, the distance between the side sections is smaller than the distance between the side sections of another part. Thereby, the cover part with a smaller distance between the side sections is received in the other cover part upon being pivoted about its pivot point, so that the two cover parts are telescopically connectable.

Advantageously, the counter-locking elements, which are provided on another of the cover parts, are arranged on outer sides of both side sections of another cover part. The locking means has correspondingly, preferably, at least two, correspondingly spaced from each other, locking elements that surrounds the another cover part for engaging the counter-locking elements in a locking position in which the locking elements engage the counter-locking elements.

Preferably, the one of the first and second cover parts is the first cover part, and the actuation member is provided at a free radial, with respect to the pivot point of the second cover part end region of the first cover part. This provides for a constructively simple and stable construction of the cover device.

Advantageously, the locking mechanism includes a spring located between the actuation section of the actuation member and a radially outer, with respect to the pivot point of the second cover part, side of the one of the first and second cover parts for biasing the actuation member in a locking position. The spring biases the actuation section advantageously radially outwardly, so that the locking section, together with the locking means, is pressed in the direction of the counter-locking means, and is retained in the locking position in which the locking means engages the counter-locking means. The spring can be formed, e.g., as a bent leaf spring, with one leg engaging an outer radial side of the corresponding cover part and with another leg engaging the actuation section radially inwardly.

Advantageously, the counter-locking means is formed as a plurality of receiving recesses for the locking means and opening radially outwardly with respect to the pivot point of the second cover part, and which for forming a grid, are provided over an arcuate section of the another of the first and second cover parts at corresponding preferably, uniform distances from each other. The selected distances between the recesses depend on arrangement of the recesses on the cover part. For securing the second cover part to the first cover part, at least one of the locking elements that form the locking means and is provided on the locking section of the actuation member, penetrates in at least one of the plurality of outwardly opening receiving recesses and reliably insures an adequate locking of the second cover part on the first cover part. The grid is advantageously adapted to the penetration depths usually produced with a disc-shaped working tool or a power tool. Advantageously, a scale with an appropriate marking is associated with the grid.

Advantageously, each receiving recess has side limiting sections spaced from each other, with a distance therebetween increasing, at least in some regions, in a direction of an opening of the receiving recess.

The receiving recesses narrow, at least in some regions, in the direction of the pivot point of the second cover part. The locking means has, for obtaining a preferably clamping connection of the second cover part with the first cover part, a profile adapted to abuttingly engage a corresponding profile of the receiving recess and which is advantageously bigger at least in one of its regions, than the corresponding profile of the receiving recess.

Advantageously, another of the first and second cover parts has a first end adapted to be brought in an overlapping relationships with the one of the first and second cover parts and the limiting section of the receiving recess adjacent to the first end has an inclination that, proceeding from the opening of the receiving recess, extends at an angle to a straight line extending through the pivot point of the second cover part. In this way, the receiving recess is provided with a lead-in section that simplifies introduction of a locking element, which is provided on the locking section of the actuation member, into a receiving recess. In addition, the second cover part can be withdrawn from the first cover part without actuation of the actuation member. This is because, upon the second cover part pivoting out, the locking element slides along the inclination. Preferably, the second cover part has, at its second, free end, which is opposite the first end, a grip member or element for pivoting the second cover part.

Advantageously, a locking element is formed as a wedge tapering to the free end of the locking section and which can easily be inserted in a receiving recess. It is particularly advantageous when the wedge shape of the locking element is adapted to the shape of the receiving opening which insures a reliable securing of the second cover part on the first cover part.

Advantageously, a distance of the pivot point of the actuation member to the pivot of the second cover part is greater than a distance of the counter-locking element to the pivot point of the second cover part.

Upon application of pressure to the cover device, the actuation member pivots counterclockwise, whereby the locking element, which is provided at the free end of the locking member, even stronger engages the counter-locking element. The provided self-locking of the locking mechanism prevents an automatic opening of the cover device during an operation of the power tool.

Advantageously, another of the first and second cover parts has a first end adapted to be brought in an overlapping relationship with the one of the first and second cover parts, and has, in an end region of the first end, a guide section for the locking means which extends from a locking element closest to the first end to the first end with a gradually reducible, radial, with respect to the pivot point of the second cover part, distance between the guide section and the first end.

For replacement of the working tool, the second cover part can be completely pivoted out with respect to the first cover part. The lead-in section enables pivoting of the second cover part towards the first cover part, without actuation of the actuation member, until the locking element is coupled with one of the counter-locking elements.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

The drawings show.

Basically, in the drawings, the same parts are designated with the same reference numerals.

DETAILED DESCRIPTION OF THE PREFERRED EMBODIMENT

Figure 1:
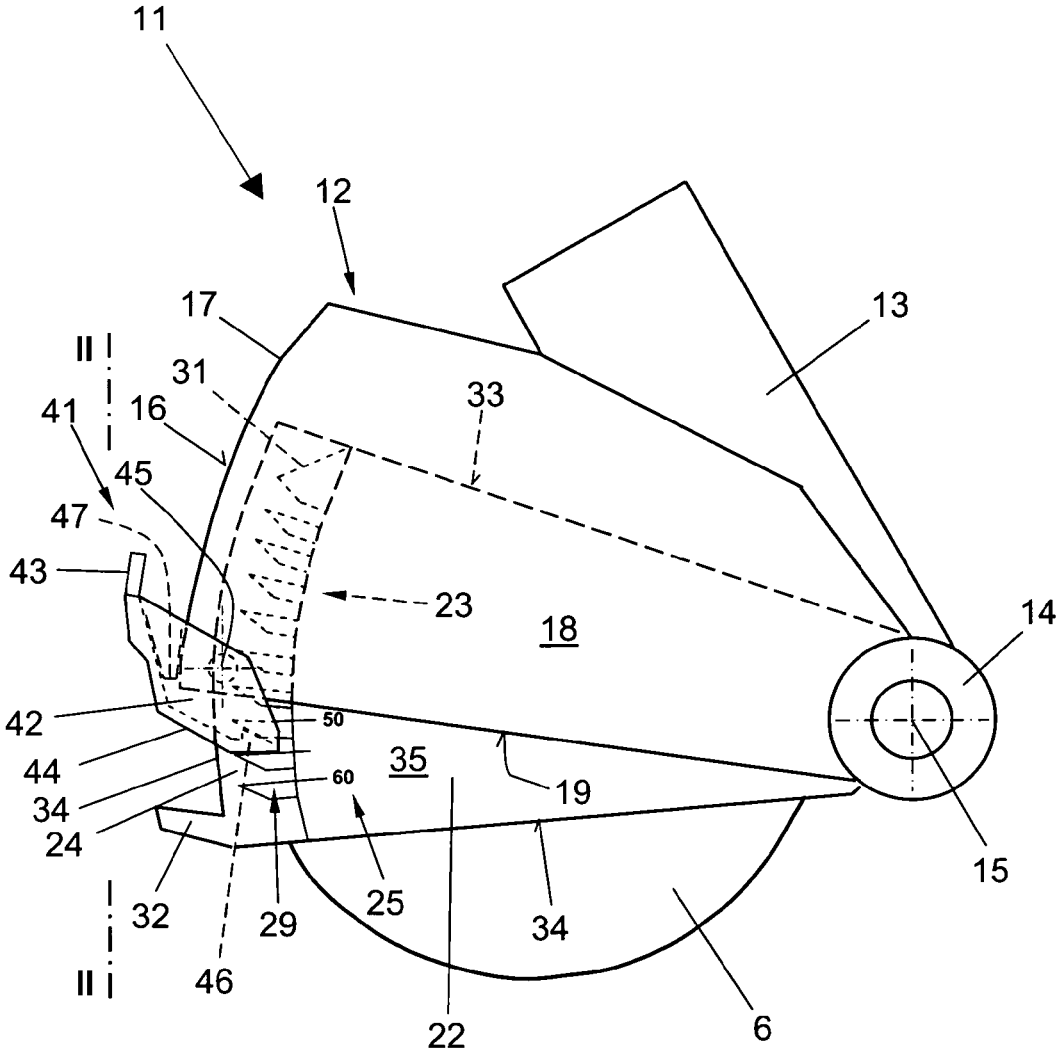
FIG. 1 a side view of a cover device according to the present invention.
Figure 2:
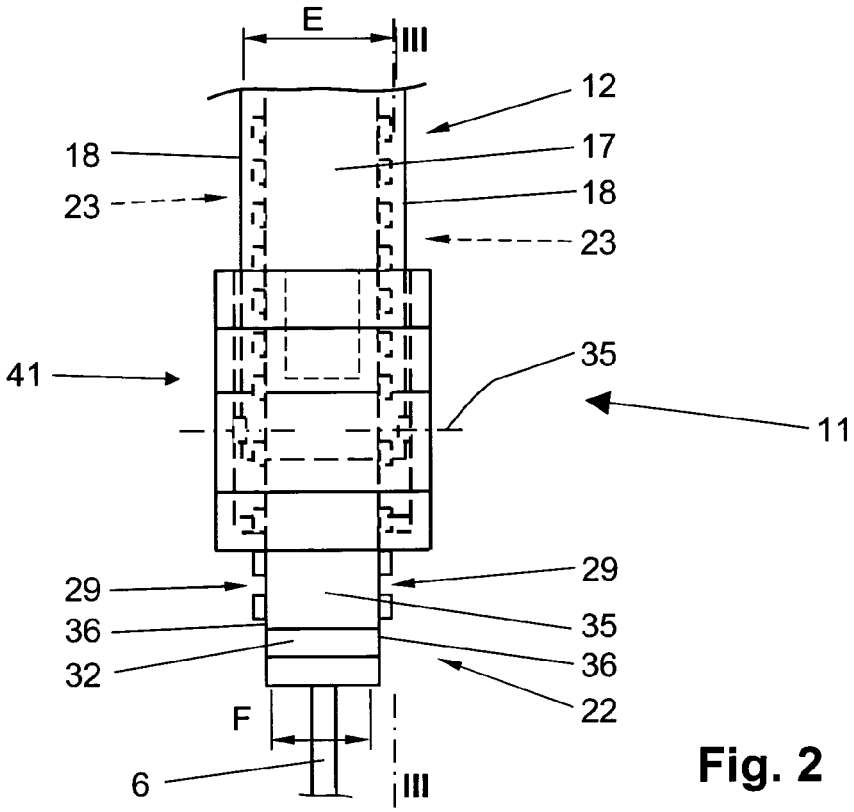
FIG. 2 a front elevational view of an actuation member of the cover device shown in FIG. 1 along line II-II.
Figure 3:
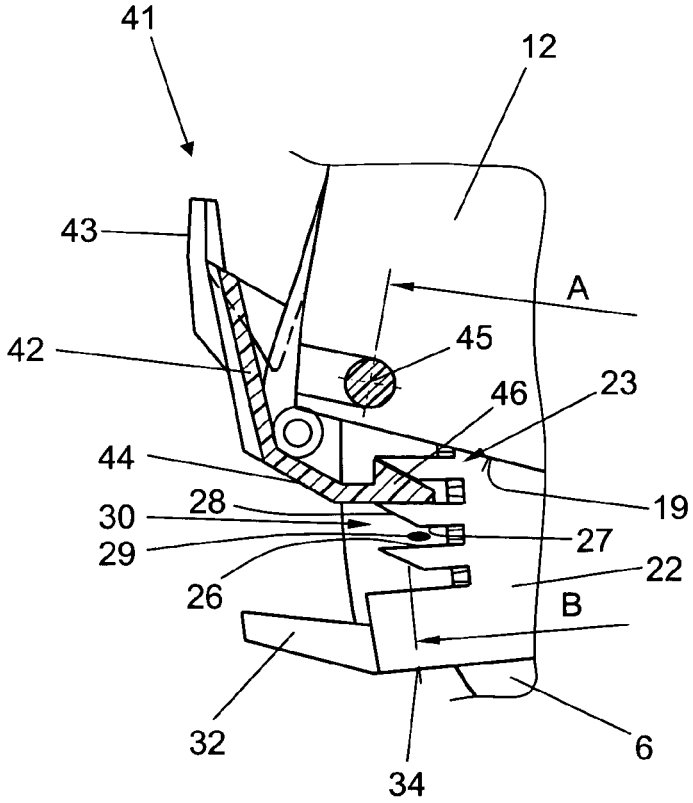
FIG. 3 a cross-sectional view along line III-III in FIG. 2.

A cover device 11 according to the present invention for a power tool (not shown) that has at least once disc-shaped working tool 6, which is shown in FIGS. 1 through 3, includes a first cover part 12 that surrounds the disc-shaped working tool 6 at least in some regions and that is fixedly mounted on the power tool. On the first cover part 12, there is provided a connection union 13 for connecting a vacuum source, such as, e.g., vacuum cleaner, for aspirating dust and particles accumulating in the cover device 11 as a result of treating a constructional component or a workpiece. There are further provided rollers 14 for guiding the cover device 11 over the constructional component. The first cover part 12 has a radial section 17, two, spaced from each by a distance E, side sections 18, and a free end 19.

The cover device 11 further includes a second cover part 22 pivotable relative to the first cover part 12 at a pivot point 15 defined by an axis of the rollers 14. The second cover part 22 has likewise a radial section 35 and two side sections 36 spaced from each other by a distance F. This distance F between the side sections 36 of the second cover part 22 is smaller than the distance E between the side sections 18 of the first cover part 12. Thereby, upon the pivotal movement of the second cover part 22, the second cover part 22 telescopically enters into the first cover part 12. The second cover part 22 also has a first end 33 capable of being brought in an overlapping relationship with the first cover part 12, and a second, opposite end 34.

There is further provided a locking mechanism 41 for establishing a maximum penetration depth of the disc-shaped working tool 6 and for releasably securing the second cover part 22 relative the first cover part 12. The locking mechanism 41 includes an actuation member 42 pivotally supported on the first cover part 12 and having an actuation section 43 and a locking section 44 extending from the actuation section 43 at angle thereto. The actuation member 42 is arranged at a free, radial, with respect to the pivot point 15 of the second cover part 22, end region of the first cover part 12. A locking element 46 is provided at a free end of the locking section 44 which is adapted to lockingly engage a counter-locking element 23 on the second cover part 22. A spring 47 is provided between the actuation section 43 of the actuation member 42 and the radial outer side 16 of the radial section 17 of the first cover part 12 for biasing the actuation member 42 in a locking position.

The counter-locking elements 23 are formed as receiving recesses 29 for the locking elements 46, which open radially outwardly with respect to the pivot point 15 of the second cover part 22. The counter-locking elements 23 are arranged on both side sections 36 of the second cover part 22 on a respective arcuate section 24. For forming a grid, the receiving recesses 29 are correspondingly advantageously, equidistantly spaced from each other. Adjacent to the counter-locking elements 23, a scale 25 is located. The scale 25 shows to the user the set penetration depth of the working tool 6 that projects from the second cover part 22.

Each receiving recess 29 has a facing each other, side, limiting sections 26 and 27 (see FIG. 3). The limiting section 26, adjacent to the second end 34 of the second cover part 22, extends essentially along a straight line extending through the pivot point 15 of the second cover part 22. The opposite limiting section 27, adjacent to the first end 33 of the second cover part 22, has an inclination 28 that is arranged, proceeding from the opening 30 of the receiving recess 29, at an angle to a straight line extending through the pivot 15 of the second cover part 22. Thereby, the distance between the limiting sections 26 and 27 increases, at least, in some regions, in the direction of the opening 30 of the receiving recess 29.

The locking element 46 has two wedges tapering toward the free end of the locking section 44 and which are spaced from each other and, in a locking position, encompass some regions the second cover part 22. The outer profile of the wedge correspond essentially to the shape of the opening 30 of the receiving recess 29 that forms a counter-locking element 23.

The radial distance A between the pivot point 45 of the actuation member 42 and the pivot point 15 of the second cover part 22 is greater than the radial distance B between the counter-locking element 23 and the pivot point 15.

The second cover part 22 has in the end region of its first end 33, a guide section 31 for the locking element 46. The guide section 31 extends from the counter-locking element 23 closest to the first end 33 of the second cover part 22 in the direction of the first end 33. The radial, with respect to the pivot point 15 of the second cover part 22, distance of the guide section 31 from the first end 33 is gradually reduced toward the first end 33. In the end region of the second end 34 of the second cover part 22, there is provided, on the radially outer, with respect to the pivot point 15, side of the second cover part 22, a grip section 32 for an easy pivoting of the second cover part 22 about its pivot point 15.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A cover device for a power tool with at least one disc-shaped working tool (6), the cover device (11) comprising:

a first cover part (12) for encompassing the disc-shaped working tool (6) of the power tool at least in some regions;

a second cover part (22) supported at a first pivot point (15) for pivotal movement relative to the first cover part (12); and a locking mechanism (41) for releasably positioning the second cover part (22) relative to the first cover part (12), the locking mechanism (41) including locking means (46) provided on one of the first and second cover parts (12, 22), counter-locking means (23) provided on another of the first and second cover parts (12, 22) and engageable with the locking means (46), and an actuation member (42) pivotally supported at a second pivot point (45) on the one of the first and second cover parts (12, 22) for pivotal movement in a direction parallel to a pivotal movement of the second cover part (22) at the first pivot point (15) and having an actuation section (43) in a plane perpendicular to a direction of the pivotal movement of the second cover part (22), and a locking section (44) extending at an angle from the actuation section (43), the locking means (46) being provided at a free end of the locking section (44).

2. A cover device according to claim 1, wherein the locking means (46) is provided on the first cover part (12), and wherein the actuation member (42) is provided at a free, radial, with respect to the pivot point (15) of the second cover part (22), of the first cover part (12).

3. A cover device according to claim 2, wherein the locking mechanism (41) includes a spring (47) located between the actuation section (43) of the actuation member (42) and a radially outer side (16), with respect to the pivot point (15) of the second cover part (22), of the first and second cover part (12) for biasing the actuation member (42) in a locking position.

4. A cover device according to claim 1, wherein the counter-locking means (23) is formed as a plurality of receiving recesses (29) for the locking means (46) and opening radially outwardly with respect to the pivot point (15) of the second cover part (22), and wherein for forming a grid, the receiving recesses (29) are provided over an arcuate section (24) of the another of the first and second cover parts (22, 12) at corresponding distances from each other.

5. A cover device according to claim 4, wherein each receiving recess (29) has side limiting sections (26, 27) spaced from each other, with a distance therebetween increasing, at least in some regions, in a direction of an opening (30) of the receiving recess (29).

6. A cover device according to claim 5, wherein the another of the first and second cover parts (12, 22) has a first end (33) adapted to be brought in an overlapping relationship with the one of the first and second cover parts (12, 22), and wherein the limiting section (27) each of the receiving recesses (29) adjacent to the first end (33) has an inclination (28) that, proceeding from the opening (30) of the respective receiving recess, extends at an angle to a straight line extending through the pivot point (15) of the second cover part (22).

7. A cover device according to claim 1, wherein the locking means (46) is formed as a wedge tapering to the free end of the locking section (44).

8. A cover device for a power tool with at least one disc-shaped working tool (6), the cover device (11) comprising:

a first cover part (12) for encompassing the disc-shaped working tool (6) of the power tool at least in some regions;

a second cover part (22) supported at a first pivot point (15) for pivotal movement relative to the first cover part (12); and a locking mechanism (41) for releasably positioning the second cover part (22) relative to the first cover part (12), the locking mechanism (41) including locking means (46) provided on one of the first and second cover parts (12, 22), counter-locking means (23) provided on another of the first and second cover parts (12, 22) and engageable with the locking means (46), and an actuation member (42) pivotally supported at a pivot point (45) on the one of the first and second cover parts (12, 22) and having an actuation section (43) and a locking section (44) extending at an angle from the actuation section (43), the locking means (46) being provided at a free end of the locking section (44), and a distance (A) of the pivot point (45) of the actuation member (42) to the pivot point (15) of the second cover part (22) is greater than a distance (B) of the counter-locking means (23) to the pivot point (15) of the second cover part (22).

9. A cover device for a power tool with at least one disc-shaped working tool (6), the cover device (11) comprising:

a first cover part (12) for encompassing the disc-shaped working tool (6) of the power tool at least in some regions;

a second cover part (22) supported at a first pivot point (15) for pivotal movement relative to the first cover part (12); and a locking mechanism (41) for releasably positioning the second cover part (22) relative to the first cover part (12), the locking mechanism (41) including locking means (46) provided on one of the first and second cover parts (12, 22), counter-locking means (23) provided on another of the first and second cover parts (12, 22) and engageable with the locking means (46), and an actuation member (42) pivotally supported at a pivot point (45) on the one of the first and second cover parts (12, 22) and having an actuation section (43) and a locking section (44) extending at an angle from the actuation section (43), the locking means (46) being provided at a free end of the locking section (44), wherein another of the first and second cover parts (12, 22) has a first end (33) adapted to be brought in an overlapping relationship with the one of the first and second cover parts (12, 22), wherein the another of the first and second cover parts (22) has, in an end region of the first end (33), a guide section (31) for the locking means (46), and wherein the guide section (31) extends from a locking element (29) closest to the first end (33) in a direction toward the first end (33), and a radial, with respect to the pivot point (15) of the second cover part (22), distance between the guide section (31) and the first end (33) is gradually reduced.

* * * * *